US012623119B2

(12) United States Patent
Zoffoli

(10) Patent No.: US 12,623,119 B2
(45) Date of Patent: May 12, 2026

(54) TRAINING METHOD ON A STRENGTH EXERCISE MACHINE USABLE BY A USER TO PERFORM A STRENGTH EXERCISE AND EXERCISE MACHINE ABLE TO IMPLEMENT SAID METHOD

(71) Applicant: TECHNOGYM S.P.A., Cesena (IT)

(72) Inventor: Luca Zoffoli, Cesena (IT)

(73) Assignee: TECHNOGYM S.P.A., Cesena (IT)

( * ) Notice: Subject to any disclaimer, the term of this patent is extended or adjusted under 35 U.S.C. 154(b) by 330 days.

(21) Appl. No.: 18/296,404

(22) Filed: Apr. 6, 2023

(65) Prior Publication Data

US 2023/0321492 A1 Oct. 12, 2023

(51) Int. Cl.
*A63B 24/00* (2006.01)

(52) U.S. Cl.
CPC ..... *A63B 24/0087* (2013.01); *A63B 24/0006* (2013.01); *A63B 24/0062* (2013.01); *A63B 2024/0009* (2013.01); *A63B 2024/0065* (2013.01); *A63B 2024/0068* (2013.01); *A63B 2024/0093* (2013.01)

(58) Field of Classification Search
CPC ..... A63B 24/0087; A63B 24/0006; A63B 2024/0009; A63B 2024/0093; A63B 21/0059; A63B 21/0628; A63B 23/0405; A63B 23/1209; A63B 2024/0068; G16H 20/30

See application file for complete search history.

(56) References Cited

U.S. PATENT DOCUMENTS

| | | | | |
|---|---|---|---|---|
| 11,260,268 | B1 * | 3/2022 | Smyser | A63B 21/4031 |
| 2004/0250618 | A1 * | 12/2004 | Keiser | A63B 21/4047 600/587 |
| 2007/0232453 | A1 * | 10/2007 | Hanoun | A63B 21/008 482/7 |
| 2017/0173394 | A1 * | 6/2017 | Rider | A63B 24/0075 |
| 2017/0361165 | A1 * | 12/2017 | Miller | A63B 21/4047 |
| 2018/0177447 | A1 * | 6/2018 | Herrala | A61B 5/222 |

* cited by examiner

*Primary Examiner* — Megan Anderson
*Assistant Examiner* — Catrina A Letterman
(74) *Attorney, Agent, or Firm* — Merchant & Gould P.C.

(57) ABSTRACT

A training method on a strength exercise machine is usable by a user to perform a strength exercise, as a series of repetitions, for training the power generable by the user in at least one first workload regimen. In case a determined or detected power peak value is either higher than or equal to a stored maximum-power reference value, the steps of updating the stored target power value as a function of the generated power peak value determined or detected, updating the stored maximum-power reference value to the determined or detected power peak value, and resetting a counter variable value are performed. In case the determined or detected power peak value is lower than the stored reference maximum power value, a step of incrementing the stored counter variable value is performed. The method is performed for each further repetition of the first workout series.

16 Claims, 8 Drawing Sheets

TRAINING METHOD ON A STRENGTH EXERCISE MACHINE USABLE BY A USER TO PERFORM A STRENGTH EXERCISE AND EXERCISE MACHINE ABLE TO IMPLEMENT SAID METHOD

CROSS-REFERENCE TO RELATED APPLICATION

This application claims priority to Italian Patent Application No. 102022000006959 filed on Apr. 7, 2022, the contents of which are incorporated by reference in their entirety.

FIELD OF THE INVENTION

The present invention relates to the fitness field, and in particular to a training method on a strength exercise machine usable by a user to perform a strength exercise, as a series of repetitions, for training the power generable by the user in at least a first workload regimen, and to an exercise machine able to implement said method.

BACKGROUND OF THE INVENTION

Strength training employing a strength exercise machine implies that a user performs repetitions by pushing a set exercise load at maximum speed during the eccentric phase of the performed movement.

In order to increase the user's performance and actually train the strength generable by the user while avoiding excessive fatigue and unnecessary strain, which could also be detrimental to health, controlling such a workout is a very important aspect and the presence of a personal trainer at the user's side or suggestions automatically provided by the exercise machine for correctly performing the exercise could not be sufficient to effectively and promptly help the user, also considering the strain condition to which the/she is subjected in the meantime.

In light of this, the need is strongly felt to have a training method on a strength exercise machine employable by a user to perform a strength exercise, as a series of repetitions, to train the power generable by the user in at least a first workload regimen, which ensures to achieve the expected results in terms of performance and improve the physical fitness while avoiding excessive fatigue, unnecessary strain, risk of injury, and so on as much as possible and in a prompt manner.

SUMMARY OF THE INVENTION

It is the object of the present invention to devise and provide a training method on a strength exercise machine employable by a user to perform a strength exercise, as a series of repetitions, to train the power generable by the user in at least a first workload regimen, which ensures to achieve the expected results in terms of performance and improve the physical fitness while avoiding excessive fatigue, unnecessary strain, risk of injury, and so on as much as possible and in a prompt manner.

Such an object is achieved by a training method on a strength exercise machine usable by a user to perform a strength exercise, as a series of repetitions, for training the power generable by the user in at least one first workload regimen. The method comprises steps of:

setting, by a data processing unit of the strength exercise machine, a set workload value movable by the user during performance of the strength exercise;

at a first repetition of a first workout series:

determining or detecting, by the data processing unit of the strength exercise machine, a power peak value generated by the user during a concentric movement performed during the first repetition of the first workout series;

storing, by the data processing unit of the strength exercise machine, in a memory unit of the strength exercise machine, the determined or detected generated power peak value as stored reference maximum power value;

determining, by the data processing unit of the strength exercise machine, a target power value as a function of the determined or detected power peak value;

storing, by the data processing unit of the strength exercise machine, in the memory unit of the strength exercise machine the determined target power value;

setting to a null value, by the data processing unit of the strength exercise machine, a counter variable in the memory unit of the strength exercise machine, at each repetition, after the first repetition, of the first workout series:

a) determining or detecting, by the data processing unit of the strength exercise machine, a power peak value generated by the user during the concentric movement performed during the repetition;

b) comparing, by the data processing unit of the strength exercise machine, the determined or detected power peak value with the stored reference maximum power value, in case c1) in which the determined or detected power peak value is either higher than or equal to the stored reference maximum power value:

d1) updating, by the data processing unit of the strength exercise machine, the stored target power value as a function of the determined or detected generated power peak value;

d2) updating, by the data processing unit of the strength exercise machine, the stored reference maximum power value to the determined or detected power peak value;

d3) resetting, by the data processing unit of the strength exercise machine, the counter variable value;

in case c2) in which the detected power peak value is lower than the stored reference maximum power value:

e1) incrementing, by the data processing unit of the strength exercise machine, the stored counter variable value;

f) performing, by the data processing unit of the strength exercise machine, steps a), b), c1), and c2) for each further repetition of the first workout series.

The present invention also relates to a strength exercise machine usable by a user for performing a strength exercise, as a series of repetitions, for training the power generable by the user in at least a first workload regimen, the exercise machine comprising:

at least one movable element operable by a user to perform a strength exercise by moving a respective workload;

at least one motor operatively connected to the at least one movable element;

a data processing unit operatively connected to said at least one motor;

a memory unit operatively connected to the data processing unit, the data processing unit being configured to:

set a set workload value movable by the user during the performance of the strength exercise;

at a first repetition of a first workout series:

determine or detect a power peak value generated by the user during a concentric movement performed during the first repetition of the first workout series;

store in the memory unit of the strength exercise machine the determined or detected power peak value as stored reference maximum power value;

determine a target power value as a function of the determined or detected power peak value;

store in the memory unit of the strength exercise machine the determined target power value;

set to a null value a counter variable in the memory unit of the strength exercise machine, at each repetition, after the first repetition, of the first workout series:

a) determine or detect a power peak value generated by the user during the concentric movement performed during the repetition;

b) compare the determined or detected power peak value with the stored reference maximum power value, in case c1) in which the determined or detected power peak value is either higher than or equal to the stored reference maximum power value:

d1) update the stored power target value as a function of the determined or detected power peak value;

d2) update the stored reference maximum power value to the determined or detected power peak value;

d3) reset the counter variable value;

in case c2) in which the determined or detected power peak value is lower than the stored reference maximum power value:

e1) increment the stored counter variable value;

f) perform steps a), b), c1), and c2) for each further repetition of the first workout series.

Preferred embodiments of the method and the exercise machine are defined in respective dependent claims.

BRIEF DESCRIPTION OF THE DRAWINGS

Further features and advantages of the method and exercise machine according to the present invention will become apparent from the following description of preferred embodiments thereof, given by way of non-limiting indication, with reference to the accompanying drawings, in which.

In the figures, equal or similar elements are indicated by the same numeric and/or alphanumeric references.

DETAILED DESCRIPTION

A strength exercise machine 100 employable by a user to perform physical activity, according to the present invention, will now be described with reference to the figures.

A strength exercise machine 100 is any exercise machine in which the user moves an exercise load or workload while performing an exercise, thus strengthening the muscles of one or more parts of his/her body, such as chest, shoulders, upper limbs, lower limbs, and so forth.

Figure 1:
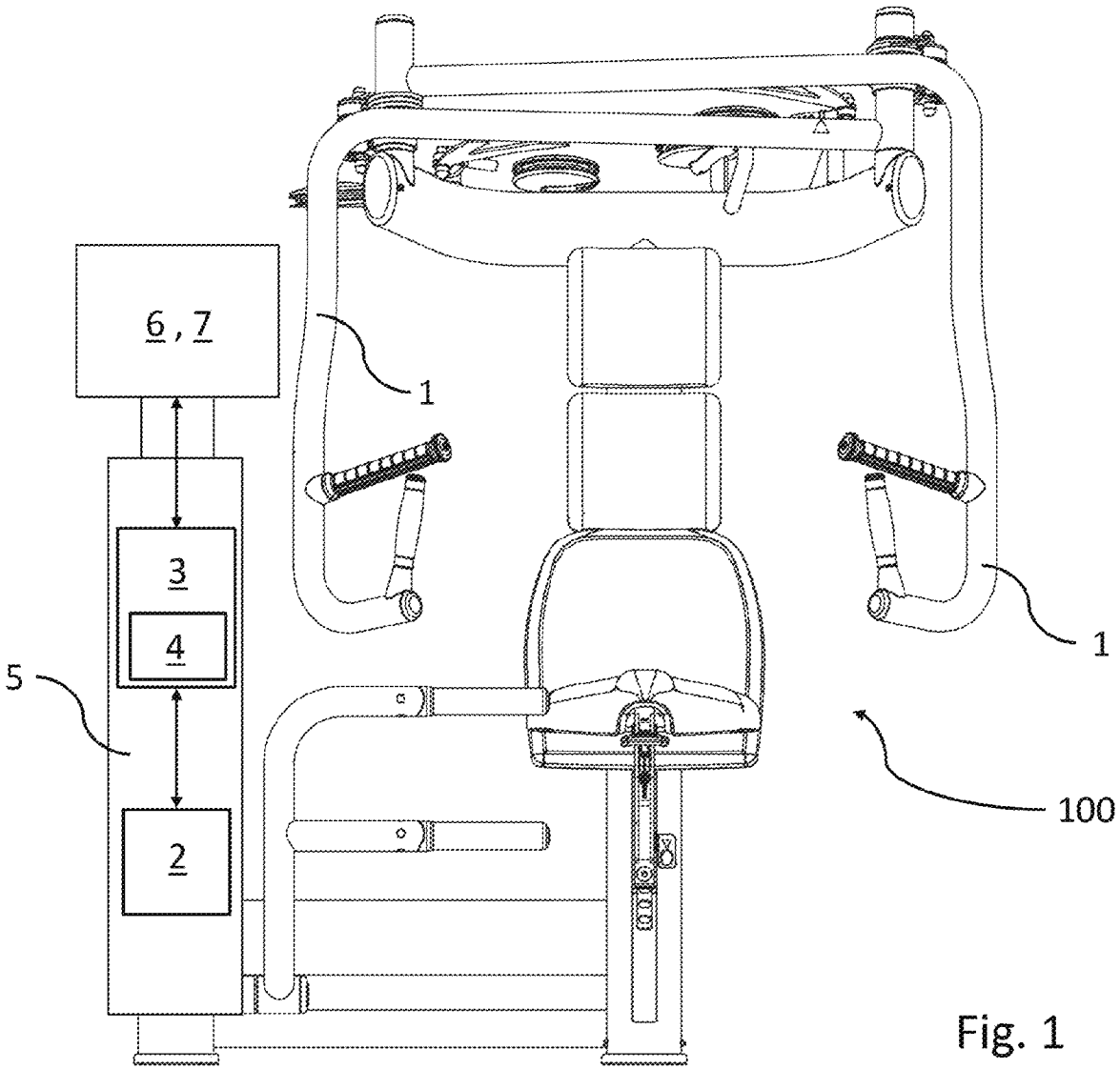
FIGS. 1 and 2 each show a respective strength exercise machine configured to implement the training method on a strength exercise machine usable by a user to perform a strength exercise, as a series of repetitions, to train the power generable by the user in at least a first workload regimen according to the present invention.
Figure 2:
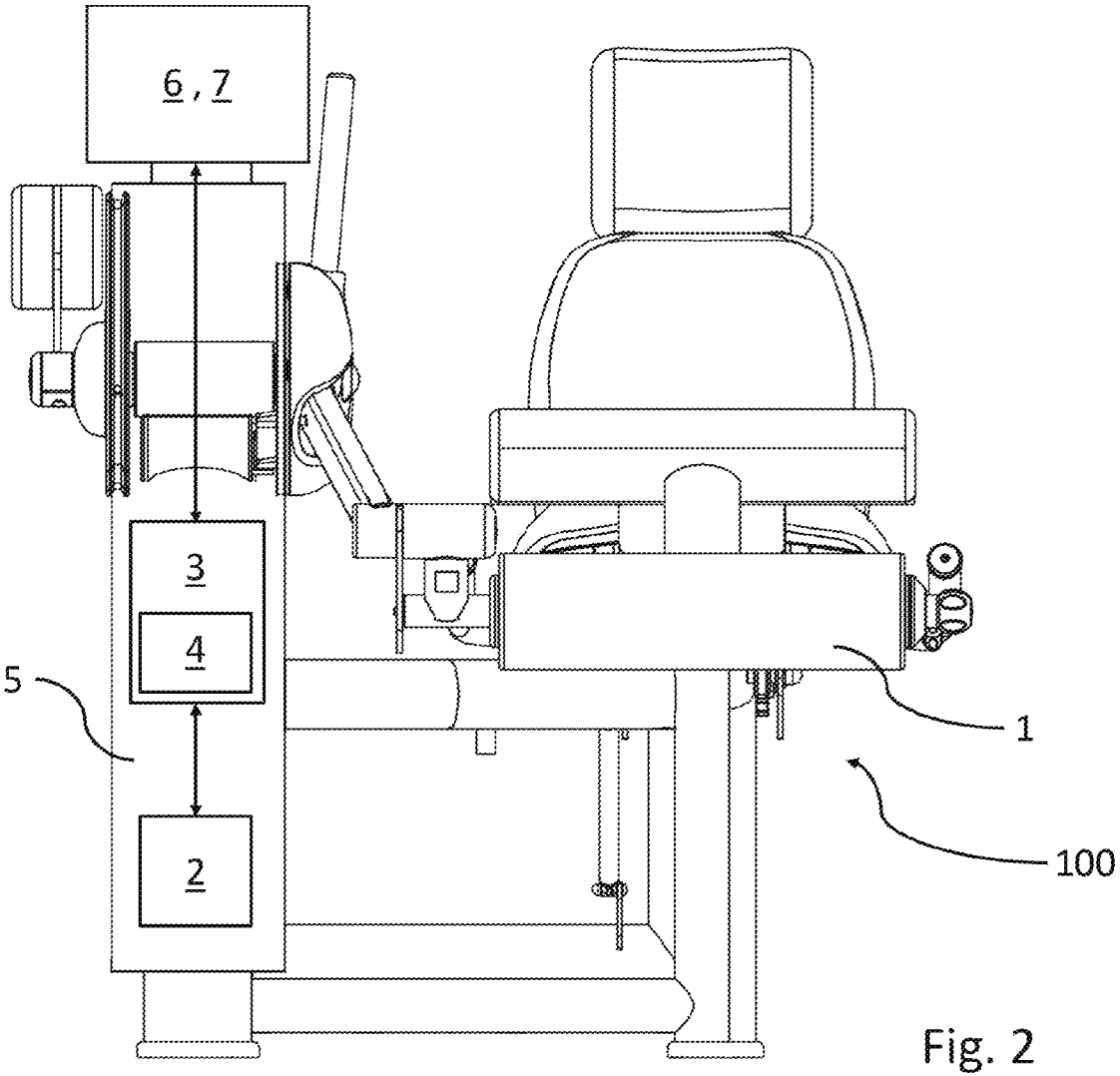

In the example of the figures, an exercise machine for strengthening the upper limbs, i.e., a "chest press", is shown in FIG. 1 and an exercise machine for strengthening the lower limbs, i.e., a "leg extension machine" is shown in FIG. 2, respectively.

With general reference to the figures, the strength exercise machine 100 comprises at least one movable element 1 actuatable by a user to perform a strength exercise by moving a respective workload or exercise load.

In particular, the at least one movable element 1 is actuatable by the user in a first movement direction (so-called concentric movement or concentric phase), which simulates the lifting of a load (workload or exercise load) of gravitational type, for example, and in a second movement direction (so-called eccentric movement or eccentric phase), in the direction opposite to the first movement direction, which simulates the return of the load (workload or exercise load) of gravitational type, for example, to the starting position.

It should be noted that the user can perform a Range Of Motion (ROM) during the actuation of the at least a first movable element 1.

Such a range of motion, in the first movement direction (concentric movement or concentric phase) is between a first starting position, in which the strength exercise machine 100, upon the user's action, is configured to begin lifting the exercise load, and a second position of movement ending, in which the user has moved the at least one movable element 1 against the resistance offered by the exercise load.

In an entirely complementary manner, the range of motion in the second movement direction (eccentric movement or eccentric phase) is between the second position of movement ending and the first starting position, in which the strength exercise machine 100, upon the user's action, is configured to begin lifting the exercise load.

In the example in FIG. 1, the at least one movable element 1 is a first lever, actuatable by a first upper limb of the user.

In this example, the strength exercise machine 100 further comprises at least a second lever, again indicated by reference numeral 1, actuatable by a second upper limb of the user.

In the example in FIG. 2, the at least one movable element 1 is a further lever actuatable by one at a time or both lower limbs of the user.

Generally referring again to FIGS. 1 and 2, the strength exercise machine 100 comprises at least one motor 2 (diagrammatically shown in the figures) operatively connected, e.g., by means of mechanical kinematic mechanisms (not shown in the figures), to the at least one movable element 1.

The at least one motor 2 is configured to apply, to the at least one movable element 1, a resistance force representative of a workload or exercise load movable by the user when performing the exercise by actuating the at least one movable element 1.

The at least one motor 2 is any motor the control of which allows applying such a resistance force, such as an electric motor, an electromagnetic motor, and so on.

The strength exercise machine 100 further comprises a data processing unit 3, such as a microprocessor or a microcontroller.

The data processing unit 3 is operatively connected to the at least one motor 2.

The strength exercise machine 100 further comprises a memory unit 4 operatively connected to the data processing unit 3.

The memory unit 4 can be internal (as diagrammatically shown in FIGS. 1 and 2) or external with respect to the data processing unit 3 (embodiment not shown in figures).

The data processing unit 3 is configured to control the strength exercise machine 100 by loading and executing one or more program codes stored in the memory unit 4.

In particular, the data processing unit 3 is configured to control the at least one motor 2.

In greater detail, the data processing unit 3 is configured to perform a training method on a strength exercise machine usable by a user to perform a strength exercise, as a series of repetitions, to train the power generable by the user in at least a first workload regimen, as will be described below.

"Workload regimen" means setting a resistance such as to ensure to the user the expression of certain power levels by promoting the achievement of a greater or lesser movement speed by the user.

Examples of "workload regimen" can be a first low-speed regimen, a second high-speed regimen, and a third maximum power regimen.

"Low-speed regimen" means setting a training load such as to ensure to the user the expression of high levels of power while limiting the user's ability to generate high speeds.

"High-speed regimen" means setting a training load such as to ensure to the user the expression of high levels of power while generating high speeds by the user.

"Maximum power regimen" means setting a training load such as to ensure to the user the expression of maximal power levels by combining the user's abilities to generate high values of force and speed, respectively.

Returning to the strength exercise machine 100 in FIGS. 1-3, in an embodiment, the strength exercise machine 100 further comprises a housing 5 in which the at least one electric motor 2, the data processing unit 3, and the memory unit 4 are housed.

Again, with reference to FIGS. 1-3, in an embodiment, in combination with any one of those described above, the exercise machine 100 further comprises a user interface 6 operatively connected to the data processing unit 3.

In this regard, it is noted that the data processing unit 3 is further configured to control the strength exercise machine 100 based on commands imparted by the user by means of the user interface 6.

In an embodiment, the user interface 6 can be of the touchscreen type.

In a further embodiment, alternative to the preceding one, the user interface 6 can be a mechanical keyboard.

In an embodiment, shown in the figures, the user interface 6 is installed on the housing 5.

In an embodiment, in combination with any one of those described above, shown in any one of the FIGS. 1-3, the strength exercise machine 100 further comprises a display module 7 operatively connected to the data processing unit 3.

The display module 7 can be used by the user during the interaction with the user interface 6.

Indeed, the display module 7 is configured to show to the user contents representative of the use of the strength exercise machine 100, e.g., identification screen, initial menu screen for setting up the workout, screen with parameters and/or graphics being updated while performing the exercise, workout summary screen, and so on.

Moreover, as described below, the display module 7 is configured to show viewable screens to the user while performing the training method of the present invention.

In this regard, examples of screens displayable by the display module 7 will be described below with reference to FIGS. 3*a*-3*e*.

Turning back again to FIGS. 1-2, in an embodiment in which the user interface 6 is of the touchscreen type, the display module 7 can coincide with the user interface 6.

It should be noted that in this embodiment, the display module 7 is also configured to show the user interface 6 to the user, in addition to contents representative of the use of the strength exercise machine 100 (examples of which have been provided above).

According to a further embodiment, alternative to the preceding one and not shown in the figures, the display module 7 is instead separate from the user interface 6.

Generally turning back to the strength exercise machine 100 according to the present invention, the data processing unit 3, during the use of the strength exercise machine 100 by a user to perform a strength exercise, as a series of repetitions, to train the power generable by the user in at least a first workload regimen, is configured to perform the operations described below.

The data processing unit 3 is configured to set a set value of workload (or exercise load) movable by the user while performing the strength exercise.

Embodiments of this setting will be described below.

The data processing unit 3, at a first repetition of a first workout series, is configured to determine or detect a power peak value P-RP generated by the user during a concentric phase of the movement performed during the first repetition of the first workout series.

For example, having set the workload, the data processing unit 3 knows the resistance torque (force) applied by the user to oppose the resistance represented by the workload.

Therefore, once the workload is known and the speed of execution of the concentric phase of the movement is determined, the power peak value P-RP generated by the user is determined, by the data processing unit 3, by multiplying the set workload value by the peak value of the speed of execution of the concentric phase of the movement.

The speed of execution of the concentric phase of the movement can be measured directly or determined from the rotation speed of the at least a first movable element 1 or determined based on the measurement of the rotation speed of the at least one motor 2.

The angular velocity can be measured, for example, by means of sensors, such as an encoder, installed on the strength exercise machine 100, or by a position sensor, installed on the strength exercise machine 100, adapted to detect the exercise position.

The peak value of the speed of execution of the concentric phase of the movement is the maximum value among those determined (for example, at sampling time instants) during the concentric phase of the movement.

It should be noted that the speed of execution of the concentric phase of the movement by the user is preferably a displacement speed of the at least one movable element 1 of the strength exercise machine 100 moved by the user.

A displacement speed corresponds to an angular speed of the at least one electric motor 2, and by virtue of a correlation table between displacement speed and angular speed, the data processing unit 3, based on the calculated angular speed of the at least one electric motor 2 (for example, deriving it from the exercise position detected by a position sensor installed on the strength exercise machine 100), can also know the displacement speed of the at least one movable element 1 moved by the user.

The data processing unit 3 of the strength exercise machine 100 is configured to store, in the memory unit 4 of the strength exercise machine 100, the generated power peak value P-RP determined or detected as a stored maximum-power reference value P-MAX.

The data processing unit 3 of the strength exercise machine 100 is configured to determine a target power value T-P as a function of the generated power peak value P-RP determined or detected.

Some embodiments of the target power value T-P value will be described hereinafter.

The data processing unit 3 of the strength exercise machine 100 is configured to store the determined target power value T-P in the memory unit 4 of the strength exercise machine 100.

The data processing unit 3 of the strength exercise machine 100 is further configured to set a counter variable in the memory unit 4 of the strength exercise machine 100 to a null value.

The data processing unit 3 of the strength exercise machine 100 is configured to perform the following operations at each repetition, after the first repetition, of the first workout series.

Firstly, the data processing unit 3 of the strength exercise machine 100 is configured to determine or detect a power peak value P-RP generated by the user during the concentric movement performed during the repetition.

An example of determining or detecting the power peak value P-RP generated by the user during the concentric movement performed during the repetition was described above with reference to the first repetition of the workout series.

The data processing unit 3 of the strength exercise machine 100 is configured to compare the determined or detected power peak value P-RP with the stored maximum-power reference value P-MAX.

If the determined or detected power peak value P-RP is greater than or equal to the stored maximum-power reference value P-MAX, the data processing unit 3 is configured to update the stored target power value T-P as a function of the generated power peak value P-RP determined or detected.

Moreover, again in this case, the data processing unit 3 of the strength exercise machine is configured to update the stored maximum-power reference value P-MAX to the determined or detected power peak value P-RP.

Furthermore, again in this case, the data processing unit 3 is configured to reset the value of the counter variable.

If the determined or detected power peak value P-RP is lower than the stored maximum-power reference value P-MAX, the data processing unit 3 is configured to leave unchanged the stored maximum-power reference value P-MAX and the stored target power value T-P in the memory unit 4 of the strength exercise machine 100.

Moreover, again in this case, the data processing unit 3 is configured to increment the stored value of the counter variable.

The data processing unit 3 is configured to perform the operations described above for each further repetition of the first workout series.

In an embodiment, in combination with the preceding one, at each repetition, after the first repetition, of the first workout series, the data processing unit 3 of the strength exercise machine 100, upon the increment of the counter variable value, is configured to compare the incremented counter variable value with a reference threshold value.

If the incremented value of the counter variable is lower than the reference threshold value, the data processing unit 3 of the strength exercise machine 100 is configured to perform the operations described above for at least one further repetition of the first workout series.

If the incremented counter variable value is equal to the reference threshold value, the data processing unit 3 of the strength exercise machine 100 is configured to interrupt the execution of the operations described above.

In an embodiment, in combination with any one of those described above, at each repetition of a second workout series, after the first workout series, the data processing unit 3 of the strength exercise machine 100 is configured to repeat the operations described above using, at the first repetition of the second workout series, the last maximum-power reference value P-MAX stored at the end of the first workout series as the stored maximum-power reference value P-MAX and the last reference target power value stored at the end of the first workout series as the stored target power value T-P.

According to an embodiment, in combination with the preceding one, at each repetition of the second workout series, after incrementing the value of the counter variable, the data processing unit 3 of the strength exercise machine 100 is configured to compare the incremented counter variable value with the reference threshold value and perform subsequent operations based on the result of such a comparison.

According to an embodiment, either in combination with any one of those described above, the set value of the workload movable by the user when performing the strength exercise is set as a function of the at least a first workload regimen chosen by the user.

According to an embodiment, in combination with any one of those described above, the set value of the workload movable by the user when performing the strength exercise is set as a set percentage of a parameter 1RM of the user.

The parameter 1RM (1-Repetition Maximum) is representative of a maximum workload or exercise load which can be moved by a user in a single repetition of a set strength exercise.

According to an embodiment, in combination with the preceding one, the set percentage of the parameter 1RM of the user is as a function of a set workload regimen.

According to an embodiment, in combination with the preceding one, the set percentage of the parameter 1RM of the user is within the range of 30%-40% in a set first high-speed regimen (preferably equal to 30%), within the range of 60%-80% in a set second low-speed regimen (preferably equal to 70%), and within the range of 41-59% in a set third maximum power regimen (preferably equal to 50%).

According to an embodiment, in combination with any one of those described above, the set value of the workload movable by the user when performing the strength exercise is set by the data processing unit 3 of the strength exercise machine 100 upon a selection, performed by the user, of the at least a first workload regimen.

The selection can be performed by the user by means of the user interface 6 of the strength exercise machine 100, as described hereinafter with reference to FIG. 3*a*.

According to an embodiment, in combination with any one of the preceding claims, the set value of the workload movable by the user when performing the strength exercise, set by the data processing unit 3 of the strength exercise machine 100, is an estimate obtained following a set test performed by the user on the strength exercise machine 100 before the workout once the at least a first workload regimen has been selected.

According to an embodiment, in combination with any one of those described above, the target power value T-P is determined by the data processing unit 3 of the strength exercise machine as a set percentage of the generated power peak value P-RP detected.

In an embodiment, in combination with the preceding one, the set percentage of the generated power peak value P-RP determined or detected is any positive value, preferably in the range of 90%-95%.

According to an embodiment, in combination with any one of those described above, the reference threshold value of the counter variable is at least a value greater than 1, preferably 2 or 3.

According to an embodiment, in combination with any one of those described above in which the counter variable is to be incremented, the data processing unit 3 of the strength exercise machine 100 is configured to provide a warning when the value of the counter variable is incremented.

Such a message can be audio and/or video provided by the user interface 6 and/or the display module 7 of the strength exercise machine 100.

Such a warning can be representative, for example, of the fact that the user is missing a repetition under the target power value T-P after which the exercise will need to be ended, of the fact that the user is training below the target power value T-P, and so on.

In an embodiment, in combination with any one of those described above, where the interruption of the execution of the method is possible, the data processing unit 3 of the strength exercise machine 100 is configured to provide an end-of-exercise message.

Such a message can be audio and/or video provided by the user interface 6 and/or the display module 7 of the strength exercise machine 100.

According to an embodiment, in combination with any one of those described above, the data processing unit 3 of the strength exercise machine 100 is configured to reset, after setting the set value of the workload movable by the user when performing the strength exercise, the stored maximum-power reference value P-MAX, the stored target power value T-P and the stored counter variable value to a null value, by the data processing unit 3 of the strength exercise machine 100, in the memory unit 4 of the strength exercise machine 100.

According to an embodiment, in combination with any one of those described above, the data processing unit 3 is configured to display graphic screens representative of the exercise being performed by the user on the display module 7 of the strength exercise machine 100.

In greater detail, the data processing unit 3 is configured to provide graphic animations of such graphic screens at the same time as the execution of the training method according to the present invention.

Figure 3A:
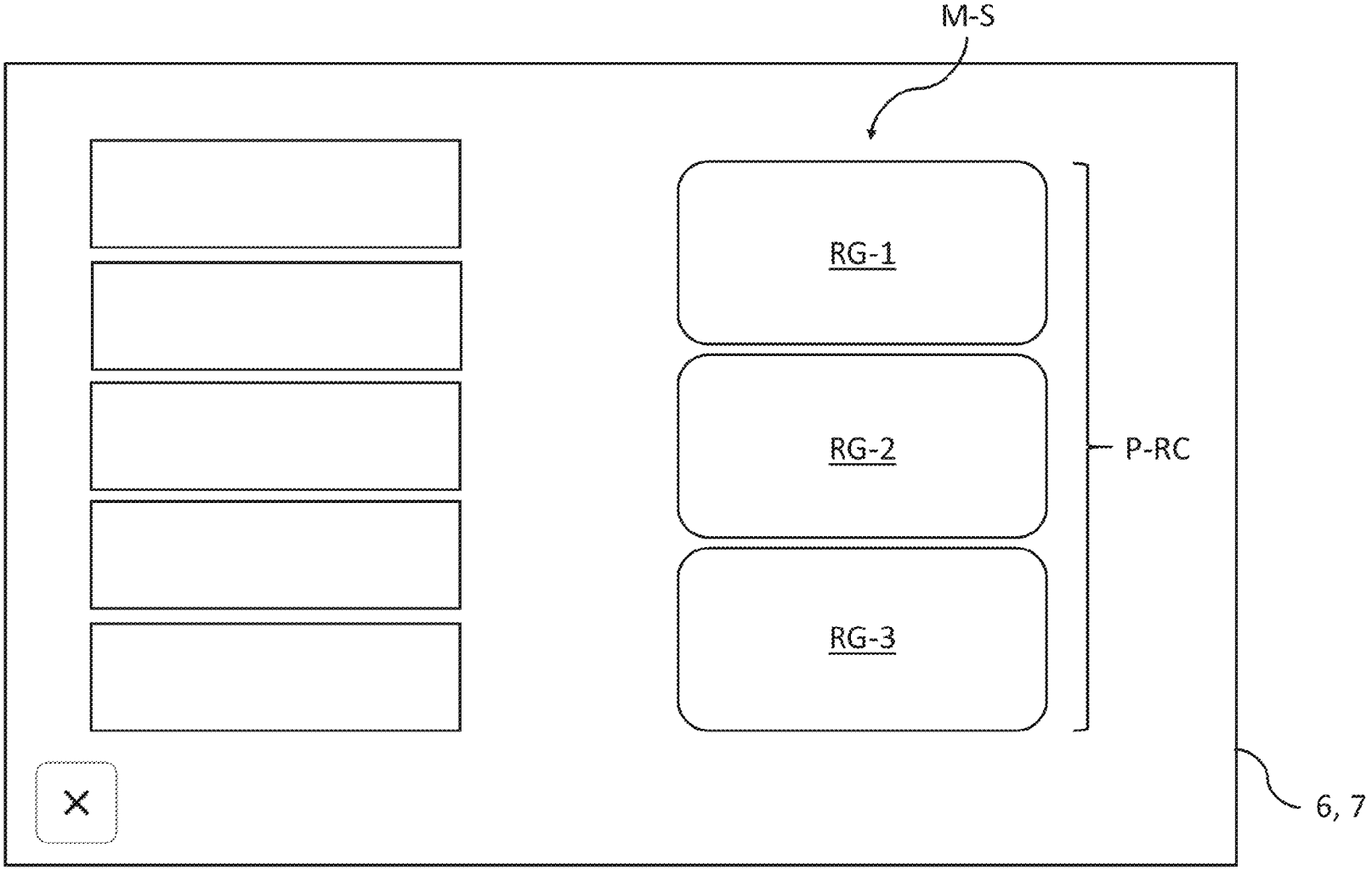
FIGS. 3*a*-3*e* show graphic screens viewable by a display module of a strength exercise machine implementing the training method on a strength exercise machine employable by a user for performing a strength exercise, as a series of repetitions, to train the power generable by the user in at least a first workload regimen according to the present invention, when performing such a method, and FIG. 4 diagrammatically shows, by means of a block diagram, a training method on a strength exercise machine usable by a user to perform a strength exercise, as a series of repetitions, to train the power generable by the user in at least a first workload regimen according to the present invention.

With reference to FIG. 3*a*, a first graphic screen viewable on the display module 7 of the strength exercise machine 100 comprises a choice menu M-S of a plurality of workload regimens P-RC which a user can select before starting the workout, by means of the graphic user interface 6 of the strength exercise machine 100.

In the example in FIG. 3*a*, the plurality of workload regimens comprises a first workload regimen RG-1 (e.g., a first high-speed regimen), a second workload regimen RG-2 (e.g., a second low-speed regimen), and a third workload regimen RG-3 (e.g., a third maximum power regimen).

With reference to FIGS. 3*b*-3*e*, each next graphic screen viewable on the display module 7 of the strength exercise machine 100 comprises:

- first information representative of the training time TA, preferably expressed in minutes and seconds;
- second information representative of the workload or current load CC, preferably expressed in kg;
- third information representative of the current number of performed repetitions RP; and
- fourth information W1 representative of a maximum-power reference value P-MAX, preferably expressed in watts.

Furthermore, each next graphic screen viewable on the display module 7 of the strength exercise machine 100 comprises a plurality of graphic elements P-G, each representative of the power peak value generated by the user during a concentric phase of the movement performed during a repetition.

In greater detail, each graphic element P-G has a graphically movable height when performing a single repetition varying from a first value representative of a null value of the power generated by the user before starting the concentric phase of the movement during the repetition and a second value representative of the peak value of the power generated by the user during a concentric phase of the movement performed during a repetition.

When performing the concentric phase of the movement performed during a repetition, the screen dynamically displays the transition of the height of the respective graphic element P-G from the first value representative of the null value of the power generated by the user to the second value representative of the peak value of the power generated by the user.

Moreover, at each repetition, each graphic element P-G is shifted towards a side of the screen (e.g., leftwards) so that with respect to the graphic element corresponding to the repetition being performed, the graphic elements representative of the repetitions already performed are arranged by a side thereof, e.g., on the left, while the graphic elements representative of the repetitions yet to be performed are arranged on the opposite side, e.g., on the right.

Figure 3B:
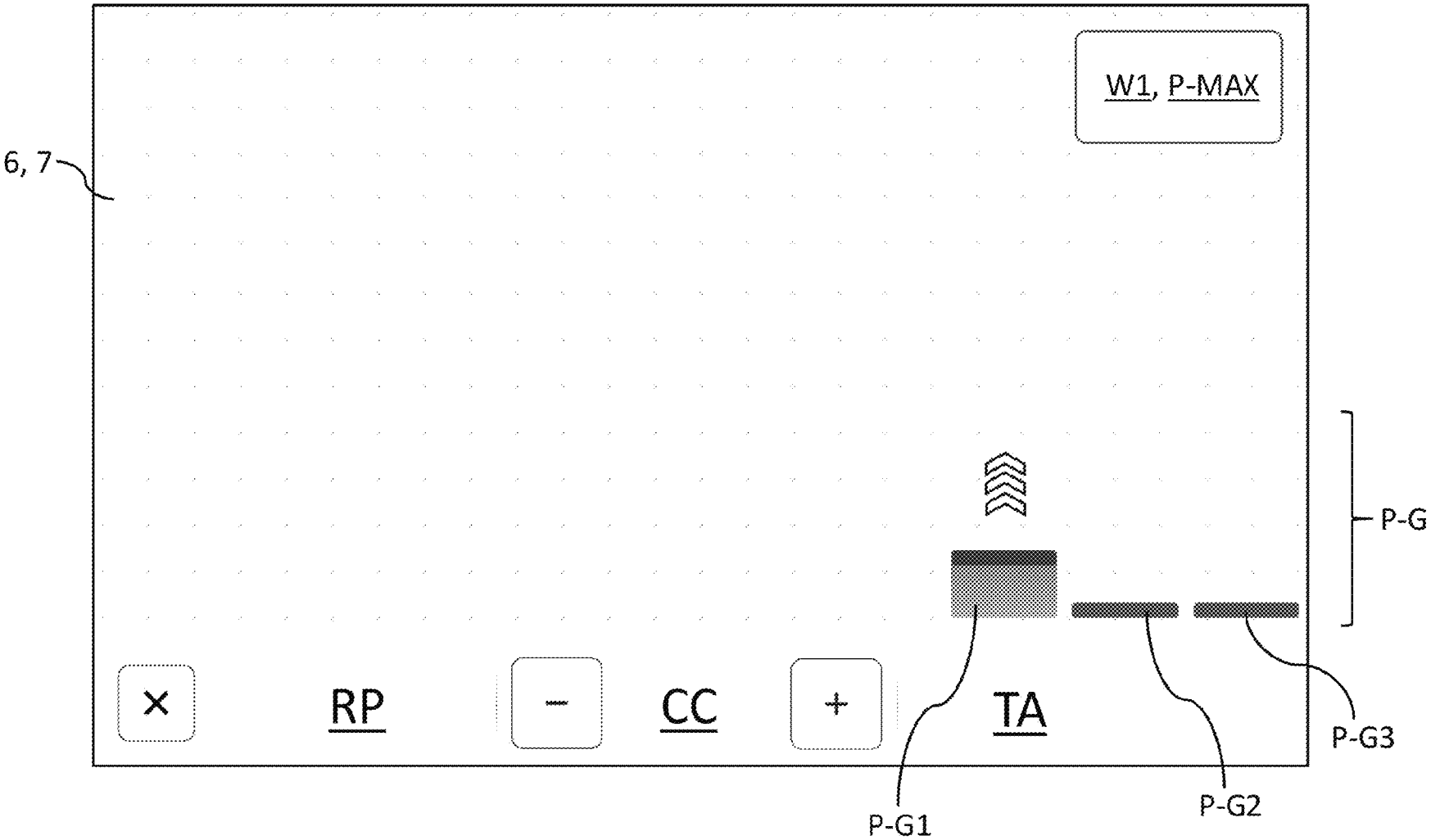

For example, with reference to the screen in FIG. 3*b*, the plurality of graphic elements P-G comprises a first graphic element P-G1, corresponding to a first repetition of a workout series the height of which is varying upwards during the concentric phase of the movement performed during the repetition, and further graphic elements P-G2, PG-3 arranged on the right corresponding to the repetitions which will be performed after the first repetition, the height of which is apparently equal to the first value representative of the null value of the power generated by the user.

Figure 3C:
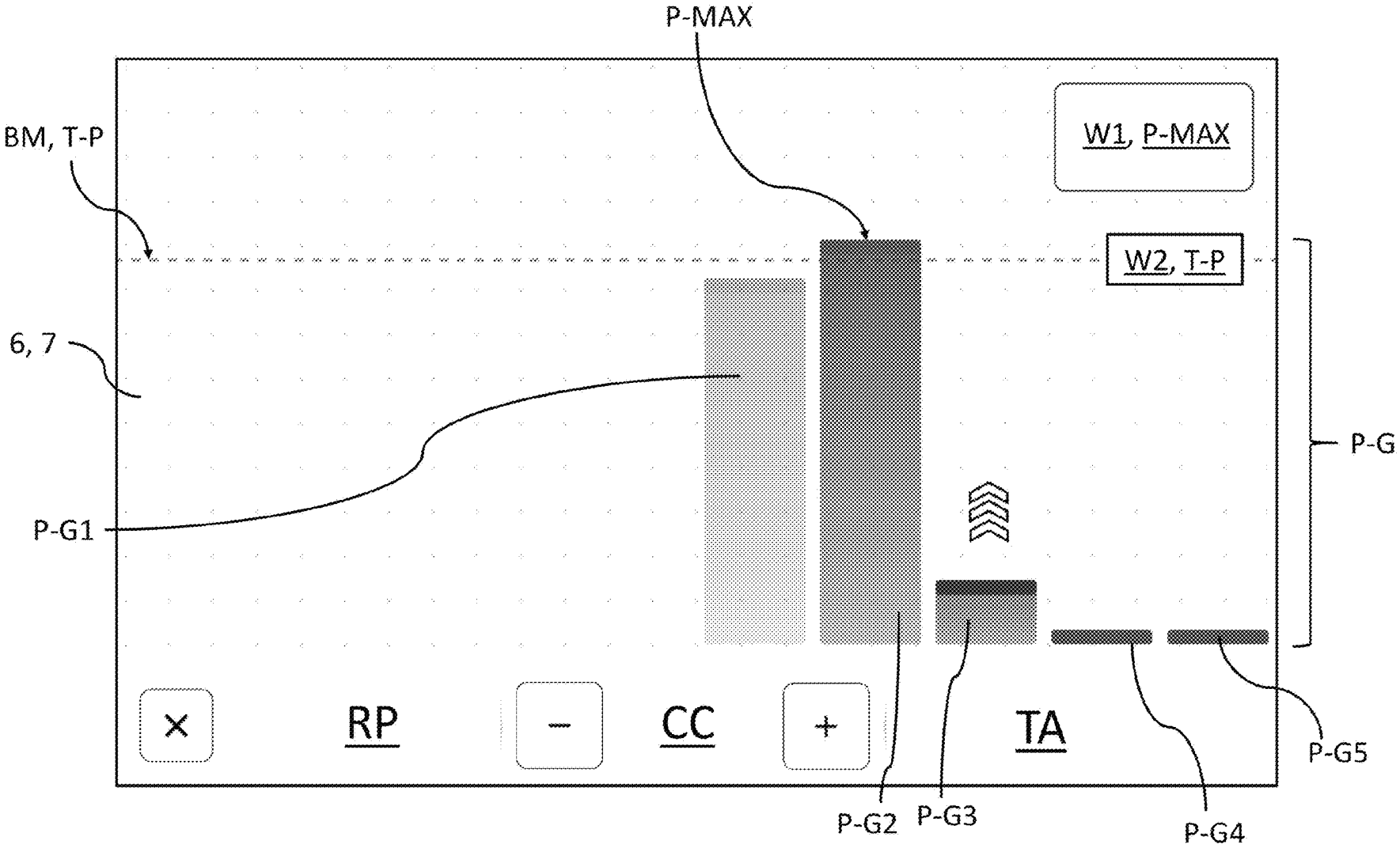

With reference to the screen in FIG. 3*c*, for example, the plurality of graphic elements P-G comprises:

the first graphic element P-G1, corresponding to the first repetition of a workout series, now completed, the height of which is equal to the second value representative of the power peak value generated by the user in the first repetition;

a second graphic element P-G2, corresponding to a second repetition of the workout series, now completed, the height of which is equal to the second value representative of the power peak value generated by the user in the second repetition; and a third graphic element PG-3, corresponding to a third repetition of the workout series, the height of which is varying upwards during the concentric phase of the movement performed during the third repetition, and further graphic elements P-G4, PG-5 corresponding to the repetitions which will be performed after the first repetition, the height of which is apparently equal to the first value representative of the null value of the power generated by the user.

With respect to the third graphic element P-G3, corresponding to the third repetition being performed, the graphic elements corresponding to the repetitions already performed (P-G1 and PG-2) are arranged on the left while the graphic elements corresponding to the repetitions yet to be performed (P-G4 and P-G5) are arranged on the right.

It should be noted that the graphic element(s) having the greatest height correspond to the repetition(s) in which the user has reached the maximum-power reference value P-MAX, which value is stored in the memory unit 4 of the strength exercise machine 100.

Figure 3D:
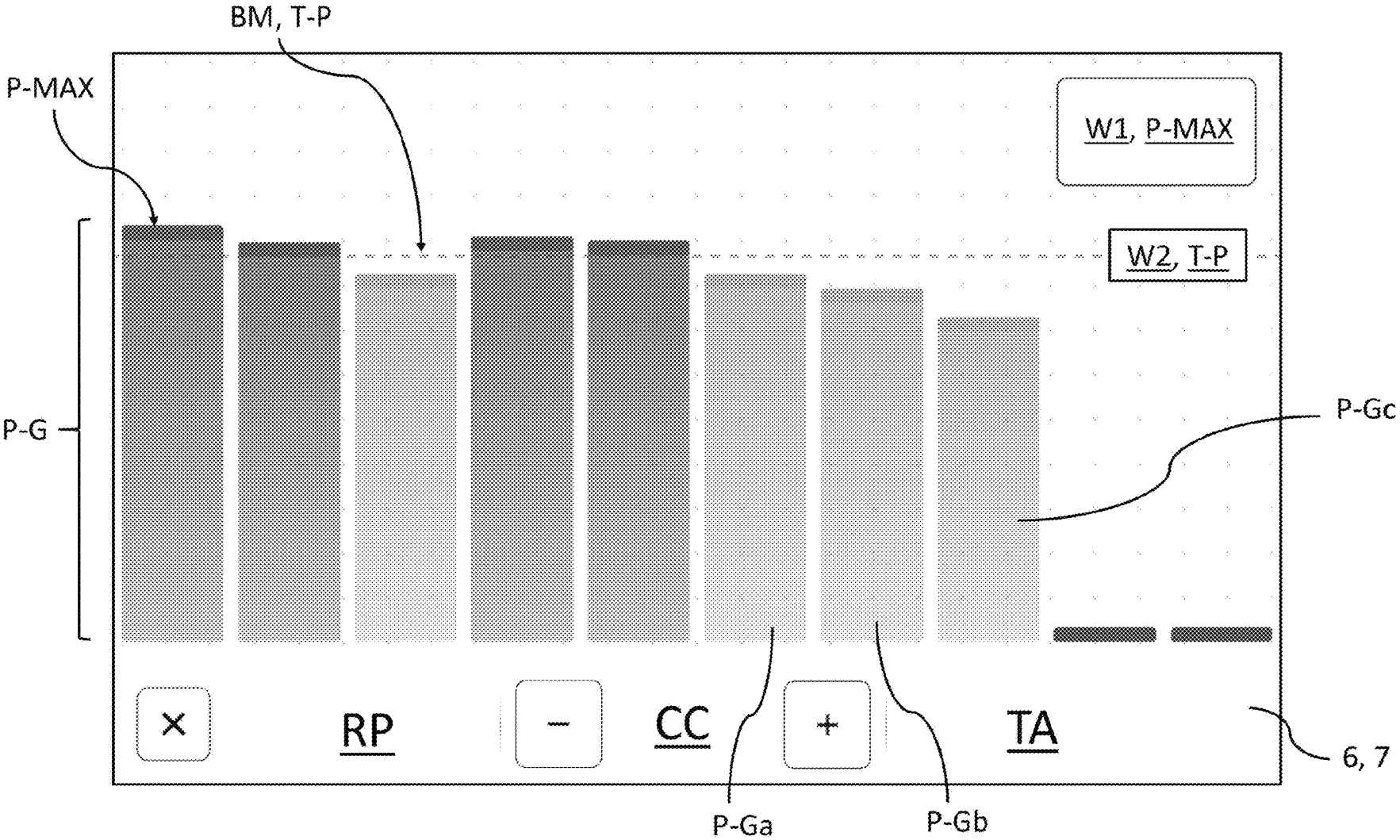
Figure 3E:
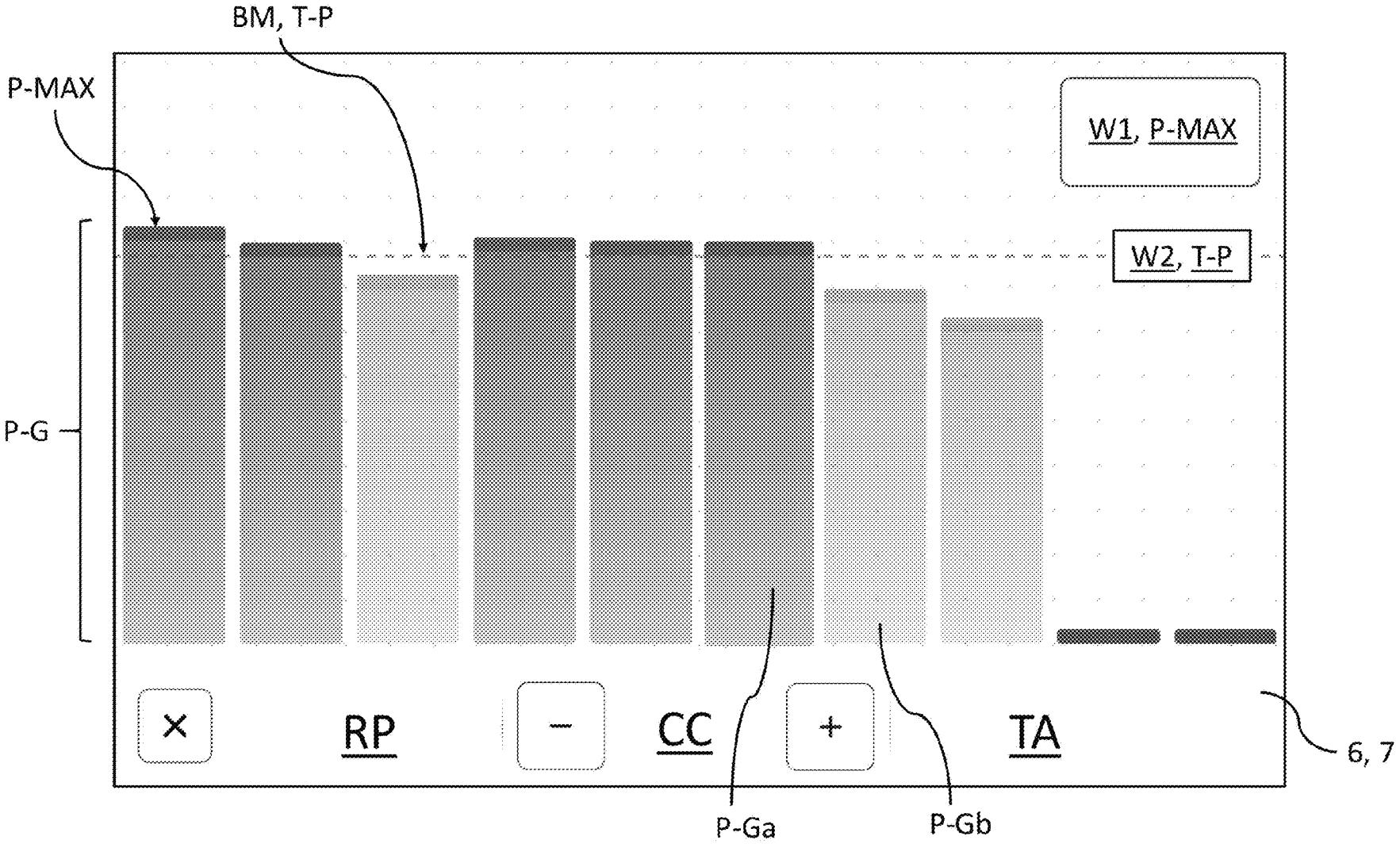

With reference to the screens in FIGS. 3*c*-3*e*, for example, each graphic screen viewable on the display module 7 of the strength exercise machine 100 comprises a preferably horizontal movable bar BM, shown in the figures by a dashed line, representative of the target power value T-P stored in the memory unit of the strength exercise machine 100.

The movable bar BM is adapted to move vertically, with respect to the plurality of graphic elements P-G, as a function of the target power value T-P stored in the memory unit 4 of the strength exercise machine 100 whenever the target power value T-P stored in the memory unit 4 of the strength exercise machine 100 is updated by the data processing unit 3 of the strength exercise machine 100.

From a graphic point of view, the relative movement between the movable bar BM and the plurality of graphic elements P-G can occur by leaving the position of the movable bar BM unchanged and varying the height of each graphic element of the plurality of graphic elements P-G or it can occur by varying the position of the movable bar BM and leaving the height of each graphic element of the plurality of graphic elements P-G unchanged.

Furthermore, in an embodiment, in combination with the preceding one, shown in FIGS. 3*b*-3*e*, each next graphic screen comprises fifth information W2 representative of the target power value T-P stored in the memory unit 4 of the strength exercise machine 100.

The fifth information W2 is preferably shown at the movable bar BM, as shown in FIGS. 3*c*-3*e*, and adapted to move vertically, with respect to the plurality of graphic elements P-G, together with the movable bar BM.

In an embodiment, in combination with any one of those described above, with reference to the graphic elements of the plurality of graphic elements P-G corresponding to the repetitions already performed by the user, the graphic elements having a height above the position of the movable bar BM are shown in a first graphic mode (e.g., a first color and/or a first graphic pattern), while the graphic elements having a height below the position of the movable bar BM is shown in a second graphic mode different from the first graphic mode (e.g., a second color different from the first color and/or a second graphic pattern different from the first graphic pattern).

Therefore, each screen shown by the display module 7 of the strength exercise machine 100 allows the user, at the end of the execution of the single repetition, to intuitively and promptly check whether the power peak value generated in the concentric phase of the movement is such as to exceed or not the target power value T-P by comparing the height of the graphic element corresponding to the repetition just performed with the position of the movable bar BM.

Moreover, each screen shown by the display module 7 of the strength exercise machine 100 allows the user, at the end of the execution of the single repetition, to intuitively and promptly check whether the power peak value generated in the concentric phase of the movement is such as to exceed or not the maximum-power reference value P-MAX stored in the memory unit 4 of the strength exercise machine 100, by comparing the height of the graphic element corresponding to the repetition just performed with the height of the graphic element corresponding to one of the already performed repetitions having a greater height.

A training method 400 on a strength exercise machine 100 usable by a user to perform a strength exercise, as a series of repetitions, for training the power generable by the user in at least a first workload regimen, hereinafter also training method 400 or simply method 400, according to the present invention will now be described with reference to FIG. 4.

The strength exercise machine 100 has been described above according to different embodiments.

The method 400 comprises a symbolic step of starting ST.

The method 400 comprises a step of setting 401, by a data processing unit 3 of the strength exercise machine 100, a set value of the workload movable by the user when performing the strength exercise.

At a first repetition of a first workout series, the method 400 further comprises a step of determining or detecting 402, by the data processing unit 3 of the strength exercise machine 100, a power peak value P-RP generated by the user during a concentric movement performed during the first repetition of the first workout series.

An example of determining or detecting the power peak value P-RP generated by the user is described above.

Again, at the first repetition of the first workout series, the method 400 then comprises a step of storing 403, by the data processing unit 3 of the strength exercise machine 100, in a memory unit 4 of the strength exercise machine 100, the generated power peak value P-RP determined or detected as a stored maximum-power reference value P-MAX.

Afterwards, again at the first repetition of the first workout series, the method 400 further comprises a step of determining 404, by the data processing unit 3 of the strength exercise machine 100, a target power value T-P as a function of the generated power peak value P-RP determined or detected.

Then, again at the first repetition of the first workout series, the method 400 further comprises a step of storing 405, by the data processing unit of the strength exercise machine 100, in a memory unit 4 of the strength exercise machine 100, the determined target power value T-P.

Again, at the first repetition of the first workout series, the method then comprises a step of setting 406, by the data processing unit 3 of the strength exercise machine 100, a variable counter value in the memory unit 4 of the strength exercise machine 100 to a null value.

At each repetition, after the first repetition, of the first workout series, the method 400 further comprises a step of a) determining or detecting 407, by the data processing unit 3 of the strength exercise machine 100, a power peak value P-RP generated by the user during a concentric movement performed during the repetition.

Again, at each repetition, after the first repetition, of the first workout series, the method 400 comprises a step of b) comparing 408, by the data processing unit 3 of the strength exercise machine 100, the determined or detected power peak value P-RP with the stored maximum-power reference value P-MAX.

In case c1), in which the determined or detected power peak value P-RP is greater than or equal to the stored reference maximum power value P-MAX, the method 400 comprises a step of d1) updating 409, by the data processing unit 3 of the strength exercise machine 100, the stored target power value T-P as a function of the generated power peak value P-RP determined or detected.

Furthermore, again in this case, the method 400 comprises a step d2) of updating 410, by the data processing unit 3 of the strength exercise machine 100, the stored maximum-power reference value P-MAX to the determined or detected power peak value P-RP.

Moreover, again in this case, the method 400 comprises a step d3) of resetting 411, by the data processing unit 3 of the strength exercise machine 100, the counter variable value.

In case c2), in which the determined or detected power peak value P-RP is lower than the stored maximum power reference value P-MAX, the method 400 comprises a step of e1) incrementing 412, by the data processing unit 3 of the strength exercise machine 100, the stored value of the counter variable.

The method 400 further comprises a step of f) performing 413, by the data processing unit 3 of the strength exercise machine 100, steps a), b), c1), and c2) for each further repetition of the first workout series.

Figure 4:
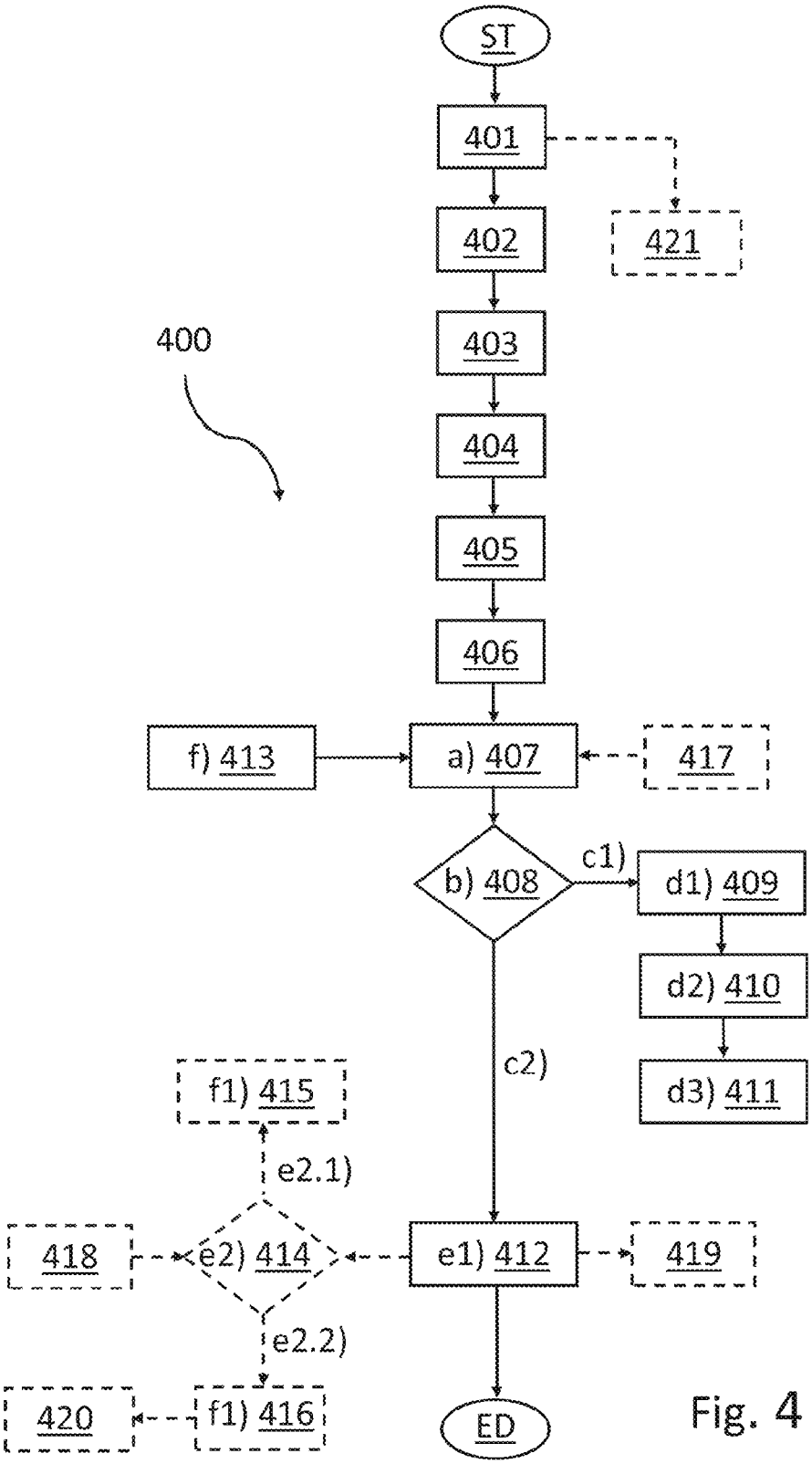

According to an embodiment, in combination with the preceding one and shown by dashed lines in FIG. 4, the method 400 comprises, at each repetition, after the first repetition, of the first workout series, after the step of e1) incrementing 412 the counter variable value, a step e2) of comparing 414 the incremented counter variable value with a reference threshold value.

In case e2.1), in which the incremented counter variable value is lower than the reference threshold value, the method 400 comprises a step f1) of performing 415, by the data processing unit 3 of the strength exercise machine 100, t steps a), b), c1), and c2) for at least one further repetition of the first workout series.

In case e2.2), in which the incremented value of the counter variable is equal to the reference threshold value, the method 400 further comprises a step g1) of interrupting 416, by the data processing unit 3 of the strength exercise machine 100, the execution of the steps of the method.

According to an embodiment, in combination with any one of those described above and shown by dashed lines in FIG. 4, at each repetition of a second workout series, after the first workout series, the method 400 comprises a step of performing 417 steps a), b), c1) and c2) using, at the first repetition of the second workout series, the last maximum-power reference value P-MAX stored at the end of the first workout series as the stored maximum-power reference value P-MAX and the last target power value T-P stored at the end of the first workout series as the stored target power value T-P.

According to an embodiment, in combination with the preceding one and shown by dashed lines in FIG. 4, the method 400 comprises, at each repetition of the second workout series, after the step e1) of incrementing 412 the value of the counter variable, a step of performing 418 the steps e2), e2.1), e2.2).

According to an embodiment, in combination with any one of those described above, the set value of the workload movable by the user when performing the strength exercise is set as a function of the at least a first workload regimen chosen by the user.

According to an embodiment, in combination with any one of those described above, the set value of the workload movable by the user when performing the strength exercise is set as a set percentage of a parameter 1RM of the user.

According to an embodiment, in combination with the preceding one, the set percentage of the parameter 1RM of the user is as a function of a set workload regimen.

According to an embodiment, in combination with the preceding one, the set percentage of the parameter 1RM of the user is within the range of 30%-40% in a set first high-speed regimen (preferably equal to 30%), within the range of 60%-80% in a set second low-speed regimen (preferably equal to 70%), and within the range of 41-59% in a set third maximum power regimen (preferably equal to 50%).

According to an embodiment, in combination with any one of those described above, the set value of the workload movable by the user when performing the strength exercise is set by the data processing unit 3 of the strength exercise machine 100 upon a selection, performed by the user, of the at least a first workload regimen.

According to an embodiment, in combination with any one of those described above, the set value of the workload movable by the user when performing the strength exercise, set by the data processing unit 3 of the strength exercise machine 100, is an estimate obtained after a set test performed by the user on the strength exercise machine 100 before the training once the at least a first workload regimen has been selected.

According to an embodiment, in combination with any one of those described above, the target power value T-P is determined by the data processing unit 3 of the strength exercise machine 100 as a set percentage of the generated power peak value P-RP determined or detected.

According to an embodiment, in combination with the preceding one, the set percentage of the generated power peak value P-RP determined or detected is any positive value, preferably in the range of 90%-95%.

According to an embodiment, in combination with any one of those described above, the reference threshold value of the counter variable is at least a value greater than 1, preferably 2 or 3.

According to an embodiment, in combination with any one of those described above in which the counter variable is incremented and shown by dashed lines in FIG. 4, the method 400 comprises a step of providing 419, by the data processing unit 3 of the strength exercise machine 100, a warning when the counter variable value is incremented.

Such a message can be audio and/or video provided by the user interface 6 and/or the display module 7 of the strength exercise machine 100.

Such a warning can be representative, for example, of the fact that the user is missing a repetition under the target power value T-P after which the exercise will need to be ended, of the fact that the user is training below the target power value T-P, and so on.

In an embodiment, in combination with any one of those described above in which the interruption of the execution of the method is provided and shown by dashed lines in FIG. 4, the method 400 further comprises a step f2) of providing 420, by the data processing unit 3 of the strength exercise machine 100, an end-of-exercise message.

Such a message can be audio and/or video provided by the user interface 6 and/or the display module 7 of the strength exercise machine 100.

According to an embodiment, in combination with any one of those described above and shown by dashed lines in FIG. 4, the method 400 comprises, after the step of setting 401 a set value of the workload movable by the user when performing the strength exercise, a step of resetting 421, by the data processing unit 3 of the strength exercise machine 100, in the memory unit 4 of the strength exercise machine 100, the stored maximum power reference value P-MAX, the stored target power value T-P and the stored counter variable value to a null value.

With reference again to FIG. 4, the method 400 further comprises a symbolic step of end ED.

An example of implementation of the training method according to the present invention is now described with reference to FIGS. 2, 3*a*-3*e*.

The user sits on the strength exercise machine 100 and logs by means of the user interface 6 of the strength exercise machine 100.

The user, by means of the user interface 6 of the strength exercise machine 100, chooses a workload regimen, e.g., a maximum power regimen (FIG. 3*a*).

The data processing unit 3 of the strength exercise machine 100 sets a set value of the workload movable by the user when performing the strength exercise as a function of the workload regimen chosen by the user.

The user performs the first repetition of a first workout series by moving the at least one movable element 1 of the strength exercise machine 100 at the fastest possible speed.

In the screen shown by the display module 7 of the strength exercise machine 100, the user sees a first graphic element P-G the height of which varies upwards (FIG. 3*b*).

At the first repetition of the first workout series, the data processing unit 3 of the strength exercise machine 100 determines or detects a power peak value P-RP generated by the user during a concentric phase of the movement performed during the first repetition of the first workout series.

An example of determining or detecting the power peak value P-RP generated by the user is described above.

Again, at the first repetition of the first workout series, the data processing unit 3 of the strength exercise machine 100 then stores, in a memory unit 4 of the strength exercise machine 100, the generated power peak value P-RP determined or detected as the stored maximum-power reference value P-MAX.

Again, at the first repetition of the first workout series, the data processing unit 3 of the strength exercise machine 100 determines a target power value T-P as a function of the generated power peak value P-RP determined or detected, e.g., 90% of the generated power peak value P-RP determined or detected.

The data processing unit of the strength exercise machine 100 then stores the determined target power value T-P in the memory unit 4 of the strength exercise machine 100.

Again, at the first repetition of the first workout series, the data processing unit 3 of the strength exercise machine 100 then sets a counter variable in the memory unit 4 of the strength exercise machine 100 to a null value.

At the next repetition of the first workout series, in the screen shown by the display module 7 of the strength exercise machine 100, the user sees graphic elements corresponding to repetitions already performed (FIG. 3*c*: first graphic element P-G1 and second graphic element P-G2), a graphic representation of the stored reference maximum power value P-MAX (FIG. 3*c*: height of the second graphic element P-G2), a graphic representation of the target power value T-P (FIG. 3*c*: movable bar BM), and a dynamic graphic representation of the fact that the repetition is being performed (FIG. 3*c*: third graphic element P-G3 the height of which varies upwards).

At the end of this repetition, the data processing unit 3 of the strength exercise machine 100 determines or detects a power peak value P-RP generated by the user during the concentric movement performed during the repetition and compares the determined or detected power peak value P-RP with the stored maximum-power reference value P-MAX.

If the determined or detected power peak value P-RP is either greater than or equal to the stored maximum-power reference value P-MAX, the data processing unit 3 of the strength exercise machine 100 updates the stored target power value T-P as a function of the generated power peak value P-RP determined or detected and updates the stored maximum-power reference value P-MAX to the determined or detected power peak value P-RP.

Furthermore, again in this case, the data processing unit 3 of the strength exercise machine 100 resets the counter variable value.

If the determined or detected power peak value P-RP is lower than the stored maximum-power reference value P-MAX, the data processing unit 3 of the strength exercise machine 100 increments the stored counter variable value, e.g., by one unit.

At the next repetition of the first workout series, the data processing unit 3 of the strength exercise machine 100 performs the operations described above with reference to the repetition following the first repetition of the first workout series.

At each repetition, after the first repetition, of the first workout series, upon incrementing the counter variable value, the data processing unit 3 of the strength exercise machine 100 compares the incremented value of the counter variable with a reference threshold value, e.g., equal to three.

If the incremented value of the counter variable is lower than the reference threshold value, the data processing unit 3 of the strength exercise machine 100 performs the aforesaid operations again for at least one more repetition of the first workout series.

If the incremented value of the counter variable is equal to the reference threshold value, the data processing unit 3 of the strength exercise machine 100 interrupts the execution of the steps of the method.

For example, this condition is shown in the screen in FIG. 3*d*, in which the user sees that the generated power peak value determined or detected for the last three repetitions performed did not exceed the target power value T-P.

FIG. 3*d* shows three graphic elements P-Ga, P-Gb, P-Gc the height of which did not exceed the movable bar BM.

Therefore, the training is stopped because, in this workout series, the user has already spent the maximum strain for the strength training, and continuing with more repetitions would not allow further performance improvement.

As can be seen, the object of the invention is fully achieved.

Indeed, the method and the related exercise machine of the present invention allow training the power generable by the user in at least a first workload regimen, ensuring to achieve the expected results in terms of performance and improve the physical fitness, while avoiding excessive fatigue, unnecessary strain, risk of injury, and so on as much as possible and in a prompt manner.

According to the method of the invention, the strength training is carried out by updating the maximum-power reference value and the target power value according to the user's performance, and the comparison of the power peak value generated by the user at each repetition with the aforementioned values allows the user to control promptly any deterioration in performance (increment in the counter variable) to interrupt the workout at the most correct and safe moment, while still ensuring that the user can perform as required by the training program.

Displaying, on the display module of the strength exercise machine 100, screens which graphically show the progress of the training advantageously allows the user to be promptly updated on the quality of the repetitions performed. The user can thus realize as soon as possible whether or not it is necessary to continue further with the repetitions or when the exercise will be close to be interrupted.

In order to meet contingent needs, those skilled in the art may make changes and adaptations to the embodiments of the method and exercise machine described above or can replace elements with others which are functionally equivalent, without departing from the scope of the following claims. All the features described above as belonging to a possible embodiment can be implemented irrespective of the other described embodiments.

The invention claimed is:

1. A training method on a strength exercise machine usable by a user to perform a strength exercise, as a series of repetitions, for training power generatable by the user in at least one first workload regimen, the strength exercise machine comprising at least one movable element operable by the user to perform the strength exercise by moving a respective workload, and at least one motor operatively connected to the at least one movable element;

the training method comprising:

controlling the at least one motor by a data processing unit of the strength exercise machine to apply a resistance force representative of a workload or exercise load;

setting, by the data processing unit of the strength exercise machine, a set workload value movable by the user during performance of the strength exercise;

at a first repetition of a first workout series:

detecting, by one or more sensors operatively connected to the data processing unit of the strength exercise machine, velocity data during a concentric movement performed during the first repetition of the first workout series;

determining by the data processing unit of the strength exercise machine, a power peak value generated by the user based on the velocity data detected by the one or more sensors during a concentric movement performed during the first repetition of the first workout series;

storing, by the data processing unit of the strength exercise machine, in a memory unit of the strength exercise machine, the determined generated power peak value as stored reference maximum power value;

determining, by the data processing unit of the strength exercise machine, a target power value as a function of the determined generated power peak value;

storing, by the data processing unit of the strength exercise machine, in the memory unit of the strength exercise machine the determined target power value;

setting to a null value, by the data processing unit of the strength exercise machine, a counter variable in the memory unit of the strength exercise machine, at each repetition, after the first repetition of the first workout series:

a) or detecting, by the one or more sensors of the data processing unit of the strength exercise machine, a power peak value generated by the user during the concentric movement performed during the repetition;

b) comparing, by the data processing unit of the strength exercise machine, the detected power peak value with the stored reference maximum power value, in case c1) in which the detected power peak value is either higher than or equal to the stored reference maximum power value:

d1) updating, by the data processing unit of the strength exercise machine, the stored target power value as a function of the detected power peak value;

d2) updating, by the data processing unit of the strength exercise machine, the stored reference maximum power value to the detected power peak value;

d3) resetting, by the data processing unit of the strength exercise machine, the counter variable value;

in case c2) in which the detected power peak value is lower than the stored reference maximum power value:

e1) incrementing, by the data processing unit of the strength exercise machine, the stored counter variable value; and f) performing, by the data processing unit of the strength exercise machine, steps a), b), c1), and c2) for each further repetition of the first workout series.

2. The training method of claim 1, wherein the set workload value movable by the user during the performance of the strength exercise is set as a set percentage of a parameter 1-Repetition Maximum (1RM) of the user.

3. The training method of claim 2, wherein the set percentage of the parameter 1RM of the user is a function of a set workload regime regimen.

4. The training method of claim 3, wherein the set percentage of the parameter 1RM of the user is within the range of 30%-40% in a set first high-speed regimen, within the range of 60%-80% in a set second low-speed regimen, and within the range of 41%-59% in a set third maximum power regimen.

5. The training method of claim 1, further comprising, at each repetition after the first repetition of the first workout series, after step e1) of incrementing the counter variable value, e2) of comparing the incremented counter variable value with a reference threshold value, in case e2.1) in which the incremented counter variable value is lower than the reference threshold value:

f1) performing, by the data processing unit of the strength exercise machine, steps a), b), c1), and c2) for at least one further repetition of the first workout series; and in case e2.2) in which the incremented counter variable value is equal to the reference threshold value:

g1) interrupting, by the data processing unit of the strength exercise machine, the performance of the steps of the training method.

6. The training method of claim 5, further comprising providing, by the data processing unit of the strength exercise machine, an alert when the counter variable value is incremented.

7. The training method of claim 5, further comprising providing, by the data processing unit of the strength exercise machine, an end-of-exercise message.

8. The training method of claim 1, further comprising, at each repetition of a second workout series, after the first workout series, performing steps a), b), c1) and c2) using, at a first repetition of the second workout series, the last stored reference maximum power value at the end of the first workout series as the stored reference maximum power value and the last stored target power value at the end of the first workout series as the stored target power value.

9. The training method of claim 8, comprising, at each repetition of the second workout series, after step e1) of incrementing the counter variable value, performing steps e2), e2.1), e2.2).

10. The training method of claim 1, wherein the set workload value movable by the user during the performance of the strength exercise is set as a function of a first workload regimen chosen by the user.

11. The training method of claim 1, wherein the set workload value movable by the user during the performance of the strength exercise is set by the data processing unit of the strength exercise machine following a selection, performed by the user, of the at least one first workload regimen.

12. The training method of claim 1, wherein the set workload value movable by the user during the performance of the strength exercise, set by the data processing unit of the strength exercise machine, is an estimate obtained as a result of a set test performed by the user on the strength exercise machine before a workout once the at least one first workload regimen has been selected.

13. The training method of claim 1, wherein the target power value is determined by the data processing unit of the strength exercise machine as a set percentage of the determined generated power peak value.

14. The training method of claim 1, comprising, after the step of setting the set workload value movable by the user during the performance of the strength exercise, resetting, by the data processing unit of the strength exercise machine, in the memory unit of the strength exercise machine, the stored reference maximum power value, the stored target power value and the counter variable value to a null value, by the data processing unit of the strength exercise machine.

15. The training method of claim 1, comprising, in case c2) in which the detected power peak value is lower than the stored reference maximum power value, leaving unchanged, by the data processing unit of the strength exercise machine, the stored reference maximum power value and the stored target power value in the memory unit of the strength exercise machine.

16. A strength exercise machine usable by a user for performing a strength exercise, as a series of repetitions, for training power generatable by the user in at least one first workload regimen, said strength exercise machine comprising:

at least one movable element operable by the user to perform the strength exercise by moving a respective workload;

at least one motor operatively connected to the at least one movable element;

one or more sensors operatively connected to the at least one movable element and configured to measure velocity data during user movement;

a data processing unit operatively connected to said at least one motor and to the one or more sensors;

a memory unit operatively connected to the data processing unit;

the data processing unit being configured to:

control the at least one motor to apply a resistance force representative of a workload or exercise load;

set a set workload value movable by the user during performance of the strength exercise;

at a first repetition of a first workout series:

detect velocity data from the one or more sensors during a concentric movement performed during the first repetition of the first workout series;

determine by the data processing unit of the strength exercise machine, a power peak value generated by the user during a concentric movement performed during the first repetition of the first workout series;

store in the memory unit of the strength exercise machine the determined generated power peak value as stored reference maximum power value;

determine a target power value as a function of the determined generated power peak value;

store in the memory unit of the strength exercise machine the determined target power value;

set to a null value a counter variable in the memory unit of the strength exercise machine, at each repetition, after the first repetition of the first workout series:

a) detect velocity data from the one or more sensors during a concentric movement performed during the repetition;

determine a power peak value generated by the user during the concentric movement performed during the repetition;

b) compare the determined er detected power peak value with the stored reference maximum power value, in case c1) in which the determined power peak value is either higher than or equal to the stored reference maximum power value:

d1) update the stored target power value as a function of the determined power peak value;

d2) update the stored reference maximum power value to the determined power peak value;

d3) reset the counter variable value;

in case c2) in which the determined power peak value is lower than the stored reference maximum power value:

e1) increment the counter variable value; and f) perform steps a), b), c1), and c2) for each further repetition of the first workout series.

* * * * *